United States Patent [19]

Pai et al.

[11] Patent Number: 4,663,258

[45] Date of Patent: May 5, 1987

[54] OVERCOATED AMORPHOUS SILICON IMAGING MEMBERS

[75] Inventors: Damodar M. Pai, Fairport; Paul J. DeFeo, Ontario, both of N.Y.

[73] Assignee: Xerox Corporation, Stamford, Conn.

[21] Appl. No.: 781,604

[22] Filed: Sep. 30, 1985

[51] Int. Cl.[4] ..... G03G 5/14

[52] U.S. Cl. ..... 430/57; 430/66; 430/84

[58] Field of Search ..... 430/57, 58, 66, 84, 430/95

[56] References Cited

U.S. PATENT DOCUMENTS

| | | | |
|---|---|---|---|
| 4,394,425 | 7/1983 | Shimizu et al. | 430/65 |
| 4,394,426 | 7/1983 | Shimizu et al. | 430/65 |
| 4,409,308 | 10/1983 | Shimizu et al. | 430/60 |
| 4,414,319 | 11/1983 | Shirai et al. | 430/65 |
| 4,418,132 | 11/1983 | Yamazaki et al. | 430/66 |
| 4,443,529 | 4/1984 | Kanbe et al. | 430/65 |
| 4,452,874 | 6/1984 | Ogawa et al. | 430/57 |
| 4,452,875 | 6/1984 | Ogawa et al. | 430/57 |
| 4,460,669 | 7/1984 | Ogawa et al. | 430/57 |
| 4,465,750 | 8/1984 | Ogawa et al. | 430/57 |
| 4,477,549 | 10/1984 | Fujimaki et al. | 430/66 |
| 4,483,911 | 11/1984 | Ogawa et al. | 430/65 |

*Primary Examiner*—John L. Goodrow
*Attorney, Agent, or Firm*—E. O. Palazzo

[57] ABSTRACT

Disclosed is imaging member comprised of a supporting substrate, a blocking layer of hydrogenated amorphous silicon with dopants, a hydrogenated amorphous silicon photoconductive layer, a first overcoating layer of non-stoichiometric silicon nitride with from between 5 to 33 atomic percent of nitrogen and 95 to 67 atomic percent of silicon, and a second overcoating layer thereover of near stoichiometric silicon nitride with from between 33 to 57 atomic percent of nitrogen, and 67 to 43 atomic percent of silicon.

40 Claims, 4 Drawing Figures

OVERCOATED AMORPHOUS SILICON IMAGING MEMBERS

BACKGROUND OF THE INVENTION

This invention is generally directed to amorphous silicon imaging members, and more specifically, the present invention is directed to photoresponsive layered imaging members, or devices comprised of hydrogenated amorphous silicon and two overcoating layers of silicon nitrides. In one embodiment of the present invention there is provided a layered photoresponsive imaging member comprised of a supporting substrate, a blocking layer of hydrogenated amorphous silicon with dopants therein, a bulk photoconducting layer of hydrogenated amorphous silicon with optional dopants therein, a first overcoating layer of nonstoichiometric silicon nitride with excess silicon, and in contact therewith a second overcoating layer of near stoichiometric silicon nitride; that is for example, where the amount of silicon present is from between about 43 to 67 atomic percent. Further, in a specific embodiment of the present invention there is provided a layered photoresponsive imaging member comprised of a supporting substrate; a blocking layer of hydrogenated amorphous silicon with a high concentration, for example about 100 parts per million, of boron therein; a bulk photoconducting layer of hydrogenated amorphous silicon with a small amount of boron therein, for example 5 parts per million; a first overcoating layer of nonstoichiometric silicon nitride with excess silicon; and in contact therewith a second overcoating layer of near stoichiometric silicon nitride. These imaging members can be incorporated into electrophotographic, and in particular xerographic imaging and printing systems. Moreover, the imaging members of the present invention possess high charge acceptance values, that is for example, in excess of 40 volts/microns; and the members can be fabricated in a desirable thickness of from, for example, about 100 microns or less. Also, the imaging members of the present invention have desirable low dark decay properties. Further, the photoresponsive imaging members of the present invention, when incorporated into xerographic imaging and printing systems, are insensitive to humidity and ions generated from corona charging devices enabling these members to formulate acceptable images of high resolution for extended time period exceeding, in most instances, more than 100,000 imaging cycles. Also, the specific overcoating of the present invention eliminate the high undesirable lateral movement of charges at the interface between the photoconducting layer and the near stoichiometric silicon nitride overcoating thereby reducing band bending, a prior art problem; and thus enabling images with increased resolution and less print deletions.

Electrostatographic imaging and particularly xerographic imaging processes are well known, and are extensively described in the prior art. In these processes a photoresponsive or photoconductor material is selected for forming the latent electrostatic image thereon. The photoreceptor is generally comprised of a conductive substrate containing on its surface a layer of photoconductive material, and in many instances, a thin barrier layer is situated therebetween to prevent charge injection from the substrate, which could adversely affect the quality of the resulting image. Examples of known useful photoconductive materials include amorphous selenium, alloys of selenium such as selenium-tellurium, selenium-arsenic, and the like. Additionally, there can be selected as photoresponsive imaging members various organic photoconductive materials including, for example, complexes of trinitrofluorenone and polyvinylcarbazole. Recently there have been disclosed layered organic photoresponsive devices with aryl amine hole transporting molecules, and photogenerating layers, reference U.S. Pat. No. 4,265,990, the disclosure of which is totally incorporated herein by reference.

Also known are hydrogenated amorphous silicon photoconductors, reference for example U.S. Pat. Nos. 4,265,991 and 4,225,222. There is disclosed in the '991 patent an electrophotographic photosensitive member comprised of a substrate, and a photoconductive overlayer of amorphous silicon containing 10 to 40 atomic percent of hydrogen and having a thickness of 5 to 80 microns. Additionally, this patent describes several processes for preparing amorphous silicon. In one process, according to the '991 patent there is prepared an electrophotographic photosensitive member which involves introducing a gas containing silicon and hydrogen atoms, providing an electrical discharge by electric energy to ionize the gas, followed by depositing amorphous silicon on an electrophotographic substrate at a rate of 0.5 to 100 Angstroms per second by utilizing an electric discharge while maintaining the temperature of the substrate between 50° C. to 350° C. thereby resulting in an amorphous silicon photoconductive layer of a predetermined thickness. Although the amorphous silicon device described in this patent is photosensitive, after a minimum number of imaging cycles, less than about 1,000 for example, unacceptable low quality images of poor resolution with many deletions may result. With further cycling, that is subsequent to 1,000 imaging cycles and after 10,000 imaging cycles, the image quality may continue to deteriorate often until images are partially deleted.

There are also illustrated in copending applications photoconductive imaging members comprised of amorphous silicon. Accordingly, for example, there is illustrated in copending application U.S. Ser. No. 695,990, entitled Electrophotographic Devices Containing Compensated Amorphous Silicon Compositions, the disclosure of which is totally incorporated herein by reference, an imaging member comprised of a supporting substrate and an amorphous hydrogenated silicon composition containing from about 25 parts per million by weight to about 1 percent by weight of boron compensated with substantially equal amounts of phosphorous. Furthermore, described in copending application U.S. Pat. No. 4,544,617, entitled Electrophotographic Devices Containing Overcoated Amorphous Silicon Compositions, the disclosure of which is totally incorporated herein by reference, are imaging members comprised of a supporting substrate, an amorphous silicon layer, a trapping layer comprised of doped amorphous silicon, and a top overcoating layer. Also, nonstochiometric silicon nitride overcoatings for amorphous silicon imaging members are disclosed in the aforementioned copending application. Additionally, described in copending application U.S. Pat. No. 4,613,556 entitled Heterogeneous Electrophotographic Imaging Members of Amorphous Silicon, the disclosure of which is totally incorporated herein by reference, are imaging members comprised of hydrogenated amorphous silicon photogenerating compositions, and a charge transporting layer of plasma deposited silicon oxide. Moreover, there are disclosed in the prior art amorphous silicon photoreceptor imaging members containing, for example, stoichiometric silicon nitride overcoatings; however, these members in some instances generate prints of low resolution as a result of the band bending phenomena. Additionally, with the aforementioned silicon nitride overcoatings, the resolution loss can in many instances be extreme thereby preventing, for example, any image formation whatsoever.

Other representative prior art disclosing amorphous silicon imaging members, including those with overcoatings, are U.S. Pat. Nos. 4,460,669; 4,465,750; 4,394,426; 4,394,425; 4,409,308; 4,414,319; 4,443,529; 4,452,874; 4,452,875; 4,483,911; 4,359,512; 4,403,026; 4,416,962; 4,423,133; 4,460,670; 4,461,820; 4,484,809; and 4,490,453. Additionally, patents that may be of background interest with respect to amorphous silicon photoreceptor members include, for example, U.S. Pat. Nos. 4,359,512; 4,377,628; 4,420,546; 4,471,042; 4,477,549; 4,486,521; and 4,490,454.

Further, other representative prior art patents that disclose amorphous silicon imaging members include, for example, U.S. Pat. No. 4,357,179 directed to method for preparing imaging members containing high density amorphous silicon or germanium; U.S. Pat. No. 4,237,501 which discloses a method for preparing hydrogenated amorphous silicon wherein ammonia is introduced into a reaction chamber; U.S. Pat. Nos. 4,359,514; 4,404,076; 4,403,026; 4,397,933; 4,423,133; 4,461,819; 4,237,151; 4,356,246; 4,361,638; 4,365,013; 3,160,521; 3,160,522; 3,496,037; 4,394,426; and 3,892,650. Of specific interest are the amorphous silicon photoreceptors illustrated in U.S. Pat. Nos. 4,394,425; 4,394,426 and 4,409,308 wherein overcoatings such as silicon nitride and silicon carbide are selected. Examples of silicon nitride overcoatings include those with a nitrogen content of from about 43 to about 60 atomic percent.

Also, processes for depositing large area defect free films of amorphous silicon by the glow discharge of silane gases is described in Chittick et al., the Journal of the Electrochemical Society, Volume 116, Page 77, (1969). The fabrication and optimization of substrate temperatures during fabrication is illustrated by Walter Spear at the Fifth International Conference on Amorphous and Liquid Semiconductors presented at Garmisch Partenkirchen, West Germany in 1963. Other fabrication processes are described in the Journal of Noncrystalline Solids, Volumes 8 to 10, Page 727, (1972), and the Journal of Noncrystalline Solids, Volume 13, Page 55, (1973).

Moreover, illustrated in a copending application U.S. Ser. No. 781,858, entitled Overcoated Amorphous Silicon Imaging Members, the disclosure of which is totally incorporated herein by reference, is an imaging member comprised of a supporting substrate, a blocking layer of hydrogenated amorphous silicon containing dopants such as boron, a bulk photoconductive layer of hydrogenated amorphous silicon; and an overcoating layer of nonstoichiometric silicon nitride. One main advantage attributed to the photoresponsive imaging member of the present application in comparison to that referred to in the copending application is the provision of a more durable imaging member in view of the presence of a second top hard overcoating layer of near stoichiometric silicon nitride.

Although the above described imaging members, particularly those disclosed in some of the copending applications, are suitable for their intended purposes there continues to be a need for improved imaging members comprised of amorphous silicon. Additionally, there is a need for hydrogenated amorphous silicon imaging members that possess desirable high charge acceptance and low charge loss in the dark. Furthermore, there continues to be a need for improved hydrogenated amorphous silicon imaging members with a first overcoating layer of nonstoichiometric silicon nitride and a second top overcoating of near stoichiometric silicon nitride enabling the substantial elimination of the undesirable lateral motion of charge, and thereby permitting the generation of images of increased resolution. Furthermore, the imaging members of the present invention are more able to withstand the abrasive wear of developer materials as compared to amorphous silicon imaging members with only nonstoichiometric overcoatings of silicon nitride. Additionally, there continues to be a need for improved layered imaging members of hydrogenated amorphous silicon which are humidity insensitive, and are not adversely effected by electrical consequences resulting from scratching and abrasion. There is also a need for amorphous silicon imaging members which can be selected for use in repetitive imaging and printing systems. Furthermore, there is a need for hydrogenated amorphous silicon imaging members with low surface potential decay rates in the dark, and photosensitivity in the visible and near visible wavelength range. Further, there is a need for improved layered hydrogenated amorphous silicon which have very few image defects such as white spots with images of dark solids.

SUMMARY OF THE INVENTION

It is therefore an object of the present invention to provide photoresponsive imaging members with high charge acceptance and low dark decay characteristics.

In another object of the present invention there are provided layered imaging members comprised of hydrogenated amorphous silicon with two overcoating layers of silicon nitrides.

In a further object of the present invention there are provided layered photoconductive imaging members comprised of blocking layers of doped amorphous silicon, and overcoatings of silicon nitrides.

Also, in a further object of the present invention there are provided layered photoconductive imaging members comprised of blocking layers of doped amorphous silicon, and overcoatings of silicon nitride containing a gradient of nitrogen with silicon rich material at the bottom and nitrogen rich material on the top.

In yet another object of the present invention there are provided layered photoresponsive imaging members which are rendered photosensitive in the near infrared region by suitable alloying of the amorphous silicon photoconductor layer with germanium and tin, or compositions based on carbon and germanium.

Another object of the present invention resides in layered imaging members comprised of amorphous silicon with a first overcoating of nonstoichiometric silicon nitrides containing excess silicon, and a second overcoating of near stoichiometric silicon nitrides, thereby substantially eliminating the lateral motion of charge at the interface of the photoconducting layer and the overcoatings permitting reduced blurring, and providing images of increased resolution.

In another object of the present invention there are provided layered imaging members comprised of amorphous silicon with a first overcoating of nonstoichiometric silicon nitride containing excess silicon, and a second overcoating of near stoichiometric silicon nitride thereby substantially eliminating image defects such as white spots.

Additionally, in a further object of the present invention there are provided imaging and printing processes with layered imaging members comprised of hydrogenated amorphous silicon with a first overcoating of nonstoichiometric silicon nitride containing excess silicon, and a second overcoating of near stoichiometric silicon nitride enabling members with increased abrasion resistance and prolonged usage in electrostatographic imaging processes.

These and other objects of the present invention are accomplished by the provision of an overcoated amorphous silicon photoresponsive imaging member. More specifically, in accordance with the present invention there are provided layered photoresponsive imaging members comprised of a supporting substrate, a blocking layer of doped hydrogenated amorphous silicon, a bulk photoconductive layer hydrogenated amorphous silicon with optional dopants therein, a first overcoating layer of nonstoichiometric silicon nitride with from between 5 to 33 atomic percent of nitrogen, and 95 to 67 atomic percent of silicon; and a top second overcoating layer of near stoichiometric silicon nitride with from between about 33 to 57 atomic percent of nitrogen, and 67 to 43 atomic percent of silicon. In one specific embodiment of the present invention there is provided a photoresponsive imaging member comprised of a supporting substrate, a blocking layer of hydrogenated amorphous silicon with, for example, about 100 parts per million of boron, a photoconducting layer of hydrogenated amorphous silicon with about 3 parts per million of boron, a first overcoating layer of nonstoichiometric silicon nitride, and a top second overcoating layer of near stoichiometric silicon nitride. Moreover, in another embodiment of the present invention a graded imaging member is provided wherein the nitrogen content in the silicon nitride overcoating increases from nonstoichiometric with excess silicon to near stoichiometric in a direction from the surface of the photoconductive layer to the overcoating layer.

The photoresponsive imaging members of the present invention when incorporated into xerographic imaging systems possess high charge acceptance values of, for example 40 volts per micron or greater, have low dark decay characteristics 100 volts per second or less, and further these members can be fabricated in thicknesses of 100 microns or less. Also, the photoresponsive members of the present invention enable the generation of images with increased resolution as a result of the elimination of the lateral movement of charge at the interface of the first overcoating and the photoconductive layer. Additionally, the aforementioned imaging members of the present invention are of excellent durability primarily as a result of the increased abrasion resistance of the near stoichiometric silicon nitride top second overcoating. Further, the imaging members of the present invention permit the generation of images with very few print defects.

As indicated hereinbefore, the photoresponsive members of the present invention can be incorporated into various imaging and printing apparatuses. Therefore, the photoresponsive imaging members of the present invention can be selected for use in xerographic printing processes, inclusive of those with solid state laser or electroluminescent light sources as these members can be rendered sufficiently sensitive to wavelengths of up to 7800 Angstroms when the photoconducting layer is suitably alloyed with germanium or tin; or fabricated from germanium-carbon alloys. The photoresponsive imaging members of the present invention when incorporated into these apparatuses are substantially insensitive to humidity and ions generated from corona charging devices, enabling the members to formulate acceptable images of high resolution for an extended number of imaging cycles exceeding, in most instances, 100,000.

BRIEF DESCRIPTION OF THE DRAWINGS

For a better understanding of the present invention and further features thereof reference is made to the following description of the preferred embodiments wherein.

Figure 1:
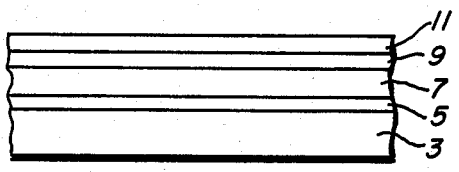
FIG. 1 is a partially schematic cross-sectional view of a photoresponsive imaging member of the present invention.

Illustrated in FIG. 1 is a photoresponsive imaging member of the present invention comprised of a supporting substrate 3; a blocking layer 5 in a thickness of from about 0.02 to 1 micron, containing hydrogenated amorphous silicon with preferably from about 10 to 40 atomic percent hydrogen, and dopants therein; a photoconductive layer containing hydrogenated amorphous silicon 7, preferably about 10 to about 40 atomic percent hydrogen, in a thickness of from about 2 to 100 microns; a first overcoating layer of nonstoichiometric silicon nitride 9 with between 5 to 33 atomic percent of nitrogen, and 95 to 67 atomic percent of silicon; and a second overcoating 11 in contact with the first overcoating comprised of near stoichiometric silicon nitride with from between 33 to 57 atomic percent of nitrogen, and between 67 to 43 atomic percent of silicon, each of the silicon nitride overcoatings being of a thickness of from about 0.01 to 2 microns.

Figure 2:
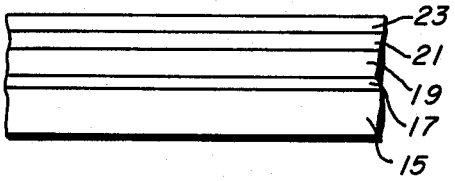
FIG. 2 is a partially schematic cross-sectional view of a further photoresponsive imaging member of the present invention.

Illustrated in FIG. 2 is a photoresponsive imaging member of the present invention comprised of a supporting substrate 15; a blocking layer 17 of hydrogenated amorphous silicon with preferably from about 10 to about 40 atomic percent of hydrogen, with about 100 parts per million of boron; a photoconducting layer in a thickness of from about 2 microns to about 100 microns of hydrogenated amorphous silicon 19 with preferably from about 10 to about 40 atomic percent of hydrogen, with about 3 parts per million of boron; a first overcoating layer of nonstoichiometric nitride 21, and a transparent second overcoating 23 in contact with the first overcoating comprised of near stoichiometric silicon nitride, each of the overcoating layers being of a thickness of from about 0.01 to about 2 microns. With further regard to the FIG. 2 overcoating, there is present 69 atomic percent silicon, and 31 atomic percent of nitrogen in layer 21; and 50 atomic percent silicon, and 50 atomic percent of nitrogen in layer 23.

Figure 3:
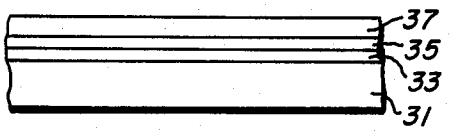
FIG. 3 is a partially schematic cross-sectional view of another photoresponsive imaging member of the present invention.

Illustrated in FIG. 3 is a photoresponsive imaging member of the present invention comprised of a supporting substrate 31; a blocking layer 33 of hydrogenated amorphous silicon with about 100 parts per million of boron; a photoconducting layer in a thickness of from about 2 microns to about 100 microns of hydrogenated amorphous silicon 35 with about 3 parts per million of boron; an overcoating layer 37 with a thickness of from 0.01 to 2 microns of graded silicon nitride wherein the silicon nitride overcoating increases from nonstoichiometric and silicon rich ($N/S_i=0$) 100 atomic percent of silicon, zero atomic percent of nitrogen, to stoichiometric ($N/S_i=1.33$) 43 atomic percent silicon, and 57 atomic percent of nitrogen, in a direction from the surface of the bulk photoconducting layer to the overcoating layer. The percentages of hydrogen present in the amorphous silicon are as illustrated herein with respect to FIG. 1.

Figure 4:
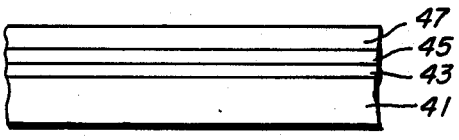
FIG. 4 is a partially schematic cross-sectional view of a prior art photoresponsive imaging member with stoichiometric overcoatings of silicon nitride.

Illustrated in FIG. 4 is a prior art photoresponsive imaging member comprised of a supporting substrate 41; a blocking layer 43 of hydrogenated amorphous silicon with about 100 parts per million of boron; a photoconducting layer of hydrogenated amorphous silicon 45 with about 3 parts per million of boron, in a thickness of from about 2.0 microns to about 100 microns; and a top overcoating layer 47 of stoichiometric silicon nitride, 43 atomic percent silicon, 57 atomic percent nitrogen ($N/Si=1.33$).

The inclusion of other elements such as germanium or tin in the hydrogenated amorphous silicon photoconductive layer can easily be accomplished by the simultaneous glow discharge of, for example, silane and germane or stannane. The alloying of hydrogenated amorphous silicon with germanium and/or tin is useful as the band gap of the alloy is smaller than that of the hydrogenated amorphous silicon itself, and thus photoresponse to longer wavelengths is obtained. Further, a thin layer of hydrogenated amorphous silicon and germanium can be introduced between the barrier and the photoconductive layer, or between the photoconductive and the first overcoating layers of FIGS. 1, 2 and 3.

The supporting substrates for each of the imaging members illustrated in the Figures may be opaque or substantially transparent, and can comprise various suitable materials having the requisite mechanical properties. Specific examples of substrates include insulating materials such as inorganic or organic polymeric substances; a layer of an organic or inorganic material having a semiconductive surface layer thereon, such as indium tin oxide; or a conductive material such as, for example, aluminum, chromium, nickel, brass, stainless steel, and the like. The substrate may be flexible or rigid and may have many different configurations such as, for example, a plate, a cylindrical drum, a scroll, an endless flexible belt, and the like. Preferably, the substrate is in the form of a cylindrical drum, or endless flexible belt. In some situations, it may be desirable to coat on the back of the substrate, particularly when the substrate is an organic polymeric material with an anticurl layer such as, for example, polycarbonates commercially available as Makrolon. The substrates are preferably comprised of aluminum with a layer of aluminum oxide, a stainless steel sleeve, or an oxidized nickel composition.

Also, the thickness of the substrate layer depends on many factors including economical considerations, and the mechanical properties desired. Accordingly thus, this layer can be of a thickness of from about 0.01 inch, 154 microns, to about 0.2 inch, 5080 microns, and preferably is of a thickness of from about 0.05 inch, 1270 microns, to about 0.15 inch, 3810 microns. In one particularly preferred embodiment, the supporting substrate is comprised of oxidized nickel in a thickness of from about 1 mil to about 10 mils.

Various blocking or barrier layers can be selected for the photoresponsive imaging members of the present invention including those comprised of amorphous silicon with p or n dopants such as boron and phosphorous. Thus, for example, for p or i (intrinsic) bulk photoconductive layers, a $p+$ type barrier is selected, obtained by doping with heavy concentrations of boron; and for n type photoconductive layers a $n+$ type barrier is utilized, obtained by doping with heavy concentrations of phosphorous. These dopants are usually present in an amount that will enable trapping of the minority carriers injected from the supporting substrate, which carriers are of an opposite charge or sign to that used for affecting discharge of the photoreceptor. Generally, thus from about 50 parts per million to about 500 parts per million of dopant is present in the blocking layer. Also, the blocking layer is of a thickness of from about 0.1 micron to about 2 micron.

Illustrative examples of materials selected for the photoconducting layer are hydrogenated amorphous silicon, preferably with 10 to 40 percent of hydrogen, including hydrogenated amorphous silicon as described in the copending applications referred to hereinbefore. Also, particularly useful as photoconducting materials are hydrogenated amorphous silicon compensated with boron and phosphorous, reference copending application U.S. Ser. No. 524,801, the disclosure of which has been incorporated herein by reference. More specifically, as indicated herein there is disclosed in this copending application an amorphous silicon composition containing from about 25 parts per million by weight to about 1 weight percent boron, compensated with from about 25 parts per million by weight to about 1 weight percent of phosphorous. Preferably, the photoconducting bulk layer is comprised of hydrogenated amorphous silicon doped with from about 1 part per million to about 10 parts per million of boron enabling a desirable reduction in dark conductivity.

An important layer with respect to the imaging members of the present invention is the first overcoating layer of nonstoichiometric silicon nitride. This overcoating must contain an excess of silicon in order to achieve the objectives of the present invention. More specifically, there is present in this layer from about 95 atomic percent to about 67 atomic percent of silicon, and from about 5 atomic percent to about 33 atomic percent of nitrogen. In this manner there is obtained an increase in the resolution of the generated images as a result of the elimination of the lateral movement of charges at the interface between the photoconducting layer and the overcoating layer.

The second overcoating layer of near stoichiometric silicon nitride, with from between 33 to 57 atomic percent of nitrogen, and 67 to 43 atomic percent of silicon, is also of importance for the imaging members of the present invention in that, for example, this overcoating improves the abrasion resistance of the imaging device; and thereby improves wear caused by the cleaning system and interaction with developer materials.

The aforementioned overcoatings are generally of a thickness of from about 0.01 to about 5 microns, and preferably from about 0.02 to about 2 microns.

With further regard to the imaging members of the present invention, although it is not desired to be limited by theory, it is believed that the band gap of $SiN_x$ varies continuously from in excess of 1.6 to 4.0 electron volts as the nitrogen content is increased from 0 to 1.33. For small values of x, that is from about 0.05 to about 0.5, the difference in band gaps between the photoconductive layer of lightly boron doped hydrogenated amorphous silicon, that is for example, less than 50 parts per million of boron; and the silicon rich nonstoichiometric first overcoating layers illustrated in FIGS. 1 and 2, for example, is relatively small, less than about 0.5 electron volts. When formulating latent images with the imaging members as illustrated in FIGS. 1, 2 and 3, initially they are charged to a positive polarity with a corotron, and are subsequently imagewise exposed. The photogenerated holes are injected into the bulk and transit to the substrate; and the photogenerated electrons are injected into and transported through the nonstoichiometric silicon rich layer. These electrons are trapped at the interface between the nonstoichiometric and near stoichiometric silicon nitride layers illustrated, for example, in FIGS. 1 and 2. With respect to the graded overcoated silicon nitride layer of FIG. 3, the photogenerated electrons are injected into the overcoated top layer, and drift therethrough. In summary, thus it is believed that the photogenerated electrons from the bulk photoconductive layers, reference FIGS. 1, 2 and 3, are removed therefrom enabling images of high resolution to be obtained.

In contrast, with the imaging member as illustrated in FIG. 4, the difference in band gap between the bulk photoconductive layer of the lightly boron doped hydrogenated amorphous silicon, with less than 50 parts per million of boron, and the near stoichiometric overcoating layer of silicon nitride is relatively high, over 2.4 electron volts. When formulating images with the imaging member of FIG. 4, it is initially charged to a positive polarity; and subsequently, it is imagewise exposed. This causes the photogenerated holes to be injected into the bulk and transit to the substrate; however, as a result of the large band gap difference between the bulk photoconductive layer and the overcoating layer, the photogenerated electrons remain in the bulk layer. It is believed that the presence of these electrons causes a band bending phenomenon resulting in the lateral migration of the charge, and thereby destroying the charge pattern of the latent image. This aforementioned band bending phenomenon, therefore, causes a substantial decrease in the image resolution; and in some instances no images whatsoever can be obtained. In any event, as detailed hereinafter, images obtained with the members of FIGS. 1, 2 and 3 are of high resolution; and in contrast, images obtained with the member of FIG. 4 are of poor resolution or no images whatsoever can be obtained.

Imaging members of the present invention can be prepared in accordance with the processes and apparatus as described in the copending applications, and U.S. patents referred to hereinbefore. More specifically, thus the imaging members of the present invention can be prepared by simultaneously introducing into a reaction chamber a silane gas often in combination with other gases for the purpose of doping or alloying, followed by the introduction of silane gas and ammonia to enable formation of the overcoating layers. In one specific embodiment, the process of preparation involves providing a receptacle containing therein a first substrate electrode means, and a second counterelectrode means providing a cylindrical surface on the first electrode means; heating the cylindrical surface with heating elements contained in the first electrode means while causing the first electrode means to axially rotate introducing into the reaction vessel a source of silicon containing gas, often in combination with other dilluting, doping or alloying gases at a right angle with respect to the cylindrical member; applying an rf voltage on the second electrode means, whereby the silane gas is decomposed resulting in the deposition of amorphous silicon or doped amorphous silicon on the cylindrical member. Thereafter, there is introduced into the reaction chamber further silane gas and diborane enabling the formation of the bulk photoconducting layer, followed by the introduction of a mixture of silane gas and ammonia in a ratio of ammonia to silane of less than 1.55 for the first nonstoichiometric layer and between 1 and 200 for the near stoichiometric second layer. The total flow rates of the gases are maintained between 50 and 400 sccm. The gas mixture pressure is maintained constant at between 250 and 1,000 milliTorr, and the radio frequency electrical power density is between 0.01 and 1 $W/cm^2$ of electrode area. The substrate temperature during the deposition process can be between 150° and 300° C.

More specifically, the amorphous silicon photoconducting layer can be formed by the glow discharge decomposition of a silane gas alone, or the decomposition of silane gas in the presence of small amounts of dopant gases such as diborane and/or phosphine. The range of useful flow rates, radio frequency power levels and reactor pressures are approximately the same as that described in the copending applications referred to herein. Specifically, 200 sccm of silane and 6 sccm of 100 parts per million diborane doped silane can be selected. Also, the specific pressure employed is about 850 mTorr, and the total rf power is about 100 watts.

Also, the two overcoatings can be fabricated using a variety of materials, such as silicon nitride layers which are plasma deposited from, for example, silane and ammonia mixtures in varying amounts depending on the atomic percentage of silicon and nitrogen desired.

This invention will now be described in detail with respect to specific preferred embodiments thereof, it being understood that these examples are intended to be illustrative only. The invention is not intended to be limited to the materials, conditions or process parameters recited herein. All parts and percentages are by weight unless otherwise indicated.

With respect to the examples that follow, except as otherwise indicated, the boron doped hydrogenated amorphous silicon and overcoating layers of silicon nitride were fabricated in a stainless steel reactor with the gas composition, pressure, rf power, time of deposition, and other parameters as detailed. Also, there were selected as the supporting substrates aluminum drums of two sizes, one with an outer diameter of 84 millimeters and a length of 400 millimeters, while the other is 84 millimeters outer diameter with a length of 335 millimeters. These drums were mounted in a stainless steel vacuum reactor, followed by rotating and heating to a temperature of 210° C. Thereafter, the reactor is evacuated by applying a vacuum thereto and the appropriate gases are introduced into the stainless steel reaction chamber with flow meters and flow valves. Throttle valves are selected to adjust the pressure, and further the fabrication was accomplished by rf (13.6 megacycles) plasma decomposition of the gases illustrated. A capacitively coupled configuration was selected by grounding the drum, and utilizing a large concentric static electrode as the rf electrode. Subsequent to fabrication of the appropriate layers, argon was passed through the reactor while the drum was being simultaneously cooled.

The amorphous silicon photoreceptor members prepared were then tested in a standard scanner for the purpose of determining the photoconductive characteristics thereof. The scanner is an apparatus in which there is provision for mounting and rotating the drum along its axis. Charging corotron exposure, erase lamps, and voltage measuring probes are mounted along the circumference. This testing was affected by permitting the scanner to operate at a surface speed of 20 revolutions per minute and subjecting the photoreceptor to a positive polarity of 7,000 volts corona potential with a 10 centimeter long corotron. Thereafter, the dark decay and the light induced decay potentials were measured by a series of electrical probes mounted along the circumference of the photoreceptor. The scanner results indicate the charging capabilities of the photoreceptor structure, that is, dark decay values; and the discharge characteristics of the photoreceptor when subjected to light illumination. Additionally, each of the photoreceptor members prepared in the examples were print tested in a Xerox Corporation 3100® or 2830® copying apparatus. The aforementioned print testing can be used to determine the resolution capabilities of the photoreceptros prepared.

EXAMPLE I

A three layer amorphous silicon photoreceptor was fabricated on an aluminum drum with a length of 400 millimeters by introducing into a reaction chamber 200 sccm of a silane gas doped with 100 parts per million of diborane, the full apparatus and process conditions being as illustrated in U.S. Pat. No. 4,466,380, the disclosure of which is totally incorporated herein by reference. The throttle present on the reactor was adjusted to obtain a plasma pressure in the reaction vessel of 375 microns while the rf power was maintained at 160 watts. This blocking barrier layer in a thickness of 5,000 Angstroms was deposited on the aluminum drum after 5 minutes, resulting in a layer consisting of hydrogenated, about 40 atomic percent of hydrogen, amorphous silicon doped with 100 parts per million of boron.

Subsequently, the bulk photoconductive layer was applied to the blocking layer by introducing into the reaction chamber 200 sccm of silane gas and 6 sccm of the silane gas doped with 100 parts per million of diborane. The plasma pressure in the chamber was maintained at 800 microns, the rf power was 100 watts, and the deposition time was 180 minutes. There resulted in a thickness of 17 micons a bulk layer consisting of hydrogenated amorphous silicon, 40 atomic percent of hydrogen doped with 3 parts per million of boron.

Thereafter, there was applied to the bulk layer a first overcoating of near stoichiometric silicon nitride by introducing into the reaction chamber 20 sccm of the silane gas and 190 sccm of ammonia. The plasma pressure in the reaction chamber was maintained at 325 microns, the rf power was set at 50 watts, and the deposition was completed in 3 minutes. There resulted in a thickness of 0.05 micron a silicon nitride overcoating with a nitrogen to silicon atomic ratio of 1.0, 50 atomic percent nitrogen, and 50 atomic percent of silicon. The silicon to nitrogen atomic ratio was confirmed by preparing on the aluminum substrate silicon nitride by flowing into a reaction chamber 20 sccm of silane gas and 190 sccm of ammonia. The plasma pressure was maintained at 325 microns and the rf power was set at 50 watts. Analysis by electron spectroscopy for chemical analysis (ESCA) technique indicated a nitrogen to silicon atomic ratio of 1.0.

Testing of this photoreceptive member in the scanner described herein indicated that a current of 40 microamps emitted from a corotron wire causes the photoreceptor to charge to 525 volts. Additionally, this photoreceptor had a dark decay rate of 100 volts per second, and further the voltage of 525 was completely discharged by a light source of less than 20 ergs/cm$^2$. This data indicates that the photoconductor possesses good photoconductive properties; however, when this imaging member was print tested in a Xerox Corporation model 3100® copier, there were generated prints of substantially zero resolution; that is, the images were blurry and could not be read.

EXAMPLE II

A three layer photoresponsive imaging member was prepared by repeating the procedure of Example I with the exception that the overcoating layer was fabricated by flowing 45 sccm of silane gas and 150 sccm of ammonia. The throttle was adjusted to obtain a plasma pressure of 308 microns, with an rf power of 40 watts. Also, the plasma deposition time was 4 minutes. There resulted, in a thickness of 0.05 micron, an overcoating layer of silicon nitride containing a nitrogen to silicon atomic ratio of 0.75. The nitrogen to silicon atomic ratio was confirmed by depositing a silicon nitride layer on an aluminum substrate by flowing into the reaction chamber 45 sccm of silane gas and 150 sccm of ammonia. The throttle was adjusted to obtain a plasma pressure of 308 microns, and the rf power of 40 watts. The nitrogen to silicon atomic ratio of the overcoating as determined by ESCA was found to be 0.75, 43 atomic percent of nitrogen.

The photoresponsive imaging member prepared was then measured in the scanner resulting in a charge acceptance of 525 volts, a dark decay of 100 volts/scc, and a light required to discharge of 20 ergs/cm$^2$. When this imaging member was print tested in the Xerox Corporation model 3100® there resulted prints of substantially zero resolution; that is, the prints were unreadable.

EXAMPLE III

A four layer photoresponsive imaging member was prepared in accordance with the procedure as detailed in Example I. More specifically, the barrier layer and second bulk photoconductive layer were fabricated by repeating the procedure of Example I. A first nonstoichiometric silicon rich silicon nitride layer was then fabricated by introducing into the reaction chamber 86 sccm of silane gas and 114 sccm of ammonia while the pressure was maintained at 300 microns and the rf power was established at 40 watts. Fabrication of this layer was completed in 4 minutes. Subsequently, a second top near stoichiometric silicon nitride overcoating layer was fabricated by introducing into the reaction chamber 25 sccm of silane and 200 sccm of ammonia at a plasma pressure of 380 microns, and an rf power of 40 watts. Fabrication was completed in 4 minutes. The resulting imaging members was then tested in a scanner resulting in a charge acceptance of 525 volts, a dark decay of 100 volts/second and a light sensitivity of less than 20 ergs/cm$^2$ required to discharge the device. Subsequently, the imaging member prepared was incorporated into a Xerox Corporation 3100® machine and prints of excellent resolution, 8 line pairs per millimeter, resulted beginning with the first imaging cycle and continuing to 25,000 imaging cycles.

ESCA analysis of the top two silicon nitride layers showed that the nitrogen to silicon ratio in the nonstoichiometric first layer to be 0.45, 31 atomic percent of nitrogen, and the second near stoichiometric layer to be close to a ratio of 1.0, 50 atomic percent of nitrogen.

EXAMPLE IV

A four layer photoresponsive imaging member was prepared in accordance with the procedure as detailed in Example I. More specifically, the barrier layer and the second bulk photoconductive layer were fabricated by repeating the procedure of Example I. A first nonstoichiometric silicon rich silicon nitride layer was then fabricated by introducing into the reaction chamber 86 sccm of the silane gas and 114 sccm of ammonia, while the pressure was maintained at 300 microns, and the rf power was established at 40 watts. Fabrication of this layer was completed in 4 minutes. Subsequently the second top near stoichiometric silicon nitride overcoating layer was fabricated by introducing into a reaction chamber 45 sccm of silane gas and 150 sccm of ammonia, at a plasma pressure of 380 microns, and an rf power of 40 watts. Fabrication was completed in 4 minutes. The resulting imaging member was then tested in the scanner resulting in a charge acceptance of 525 volts, a dark decay of 100 volts/second, and a light sensitivity of less than 20 ergs/cm$^2$ to discharge. Subsequently, the imaging member prepared was incorporated into a Xerox Corporation 3100® machine, and prints of excellent resolution, 8 line pairs per millimeter, resulted beginning with the first imaging cycle and continuing to 25,000 imaging cycles.

ESCA analysis indicated that there was present 31 atomic percent of nitrogen in the first overcoating, and 43 atomic percent of nitrogen in the second overcoating.

EXAMPLE V

Further testing of the imaging member prepared in Example IV was accomplished by removing a small piece thereof in a dimension of 1 inch by 1 inch square.

Studies were accomplished by ESCA and the stepwise nitrogen to silicon ratio was observed. The first overcoating layer of the imaging member of Example IV possessed a nitrogen to silicon atomic ratio of 0.45, 31 atomic percent of nitrogen, and 69 atomic percent of silicon, while the second overcoating layer had a nitrogen to silicon ratio of 0.75, 43 atomic percent of nitrogen and 57 atomic percent of silicon.

Although the invention has been described with reference to specific preferred embodiments, it is not intended to be limited thereto. Rather those of skill in the art will recognize that variations and modifications may be made therein which are included within the spirit of the present invention and within the scope of the following claims.

What is claimed is:

1. An imaging member comprised of a supporting substrate, a blocking layer of hydrogenated amorphous silicon with dopants, a hydrogenated amorphous silicon photoconductive layer, a first overcoating layer of nonstoichiometric silicon nitride with from between 5 to 33 atomic percent of nitrogen and 95 to 67 atomic percent of silicon, and a second overcoating layer thereover of near stoichiometric silicon nitride with from between 33 to 57 atomic percent of nitrogen, and 67 to 43 atomic percent of silicon.

2. An imaging member in accordance with claim 1 wherein the blocking layer is coped with boron.

3. An imaging member in accordance with claim 1 wherein the dopant is present in an amount of from about 100 parts per million to about 500 parts per million.

4. An imaging member in accordance with claim 1 wherein the amorphous silicon photoconducting layer contains dopants therein.

5. An imaging member in accordance with claim 4 wherein the dopants are present in an amount of from about 3 parts per million to 20 parts per million.

6. An imaging member in accordance with claim 1 wherein the photoconductive layer is comprised of hydrogenated amorphous silicon doped with boron or simultaneously doped with boron and phosphorous in an amount of from about 2 parts per million to about 100 parts per million.

7. An imaging member in accordance with claim 1 wherein the photoconductive layer is comprised of a hydrogenated amorphous silicongermanium alloys.

8. An imaging member in accordance with claim 1 wherein the photoconductive layer is comprised of a hydrogenated amorphous silicon-tin alloy.

9. An imaging member in accordance with claim 1 wherein the photoconductive layer is comprised of a hydrogenated amorphous carbongermanium alloy.

10. An imaging member in accordance with claim 1 wherein the first overcoating layer is comprised of silicon nitride with from between 95 to 66.6 atomic percent of silicon, and 5 to 33.4 atomic percent of nitrogen.

11. An imaging member in accordance with claim 1 wherein the second overcoating layer is comprised of silicon nitride with from between 67 to 43 atomic percent of silicon, and 33 to 57 atomic percent of nitrogen.

12. An imaging member in accordance with claim 1 wherein the substrate is comprised of aluminum.

13. An imaging member in accordance with claim 1 wherein the substrate is a flexible belt.

14. An imaging member in accordance with claim 1 wherein the thickness of the photoconductive layer is from about 1 micron to about 50 microns.

15. An imaging member in accordance with claim 1 wherein the thickness of the first overcoating layer is from about 0.001 micron to about 1 micron.

16. An imaging member in accordance with claim 1 wherein the thickness of the second overcoating layer is from about 0.02 micron to about 2 microns.

17. A method of imaging which comprises providing the photoresponsive imaging member of claim 1, subjecting this member to imagewise exposure, developing the resulting image with a toner composition, subsequently transferring the image to a suitable substrate, and optionally permanently affixing the image thereto.

18. A method of imaging in accordance with claim 17 wherein the photoconductive layer is comprised of hydrogenated amorphous silicon doped with boron, or simultaneously doped with boron and phosphorous in an amount of from about 2 parts per million to about 100 parts per million.

19. A method of imaging in accordance with claim 17 wherein the photoconductive layer is comprised oa a hydrogenated amorphous silicon-germanium alloy.

20. A method of imaging in accordance with claim 17 wherein the photoconductive layer is comprised of a hydrogenated amorphous silicontin alloy.

21. A method of imaging in accordance with claim 17 wherein the photoconductive layer is comprised of a hydrogenated amorphous carbongermanium alloy.

22. A method of imaging in accordance with claim 17 wherein the thickness of the photoconductive layer is from about 1.0 micron to about 50 microns.

23. A method of imaging in accordance with claim 17 wherein the thickness of the first overcoating layer is from about 0.01 micron to about 1.0 micron.

24. A method of imaging in accordance with claim 17 wherein the thickness of the second overcoating layer is from about 0.02 micron to about 2 microns.

25. A method of imaging in accordance with claim 17 wherein the blocking layer is doped with boron.

26. A method of imaging in accordance with claim 17 wherein dopants are present in an amount of from about 100 parts per million to about 500 parts per million.

27. A method of imaging in accordance with claim 17 wherein the first overcoating layer is comprised of silicon nitride with 95 to 67 atomic percent of silicon, and between 5 to 33 atomic percent of nitrogen.

28. A method of imaging in accordance with claim 17 wherein the second overcoating layer is comprised of silicon nitride with from between 67 to 43 atomic percent of silicon, and 33 to 57 atomic percent of nitrogen.

29. An imaging member in accordance with claim 17 wherein the substrate is comprised of aluminum.

30. An imaging member in accordance with claim 17 wherein the substrate is a flexible belt.

31. An imaging member consisting essentially of a supporting substrate, a blocking layer of hydrogenated amorphous silicon with dopants therein in an amount of from about 100 to about 500 parts per million, a hydrogenated amorphous silicon photoconducting layer having incorporated therein from about 3 to about 20 parts per million of dopants, and thereover a silicon nitride overcoating wherein the silicon and nitrogen are present therein in a gradient extending from the surface of the photoconductive layer to the top of the overcoating layer, said amount increasing from nonstoichiometric to near stoichiometric.

32. An imaging member in accordance with claim 31 wherein the blocking layer is doped with boron.

33. An imaging member in accordance with claim 32 wherein the boron is present in an amount of from about 100 parts per million to about 500 parts per million.

34. An imaging member in accordance with claim 31 wherein the photoconductive layer is comprised of amorphous silicon doped with boron or simultaneously doped with boron and phosphorous in an amount of from about 2 parts per million to about 100 parts per million.

35. An imaging member in accordance with claim 31 wherein the photoconductive layer is comprised of a hydrogenated amorphous silicon-germanium alloy.

36. An imaging member in accordance with claim 31 wherein the photoconductive layer is comprised of a hydrogenated amorphous silicon-tin alloy, or an amorphous carbon-germanium alloy.

37. An imaging member in accordance with claim 31 wherein the silicon nitride layer is of a thickness of from about 0.01 micron to about 2 microns.

38. An imaging member consisting essentially of a supporting substrate, a blocking layer of hydrogenated amorphous silicon with dopants, a hydrogenated amorphous silicon photoconductive layer, a first overcoating layer of nonstoichiometric silicon nitride with from between 5 to 33 atomic percent of nitrogen and 95 to 67 atomic percent of silicon, and a second overcoating layer thereover of near stoichiometric silicon nitride with from between 33 to 57 atomic percent of nitrogen, and 67 to 43 atomic percent of silicon.

39. An imaging member in accordance with claim 38 wherein the nitrogen to silicon ratio on the nonstoiehiometric first layer is 0.45, and comprised of 31 atomic percent of nitrogen and 69 atomic percent of silicon; and the second near stoichiometric layer is comprised of 50 atomic percent of nitrogen and 50 atomic percent of silicon.

40. An imaging member in accordance with claim 38 wherein the first overcoating layer contains 31 atomic percent of nitrogen and 69 atomic percent of silicon, and the second overcoating layer contains 43 atomic percent of nitrogen and 57 atomic percent of silicon.

* * * * *